US009152102B2

(12) United States Patent
Yoo

(10) Patent No.: US 9,152,102 B2
(45) Date of Patent: Oct. 6, 2015

(54) IMAGE FORMING APPARATUS

(75) Inventor: Jae-seok Yoo, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 434 days.

(21) Appl. No.: 13/585,487

(22) Filed: Aug. 14, 2012

(65) Prior Publication Data

US 2013/0121708 A1 May 16, 2013

(30) Foreign Application Priority Data

Nov. 10, 2011 (KR) ..... 10-2011-0117068

(51) Int. Cl.
*G03G 21/16* (2006.01)
*G03G 15/20* (2006.01)

(52) U.S. Cl.
CPC ..... *G03G 15/2035* (2013.01); *G03G 21/1638* (2013.01); *G03G 21/1685* (2013.01); *G03G 2221/1687* (2013.01)

(58) Field of Classification Search
CPC . B41J 29/13; G03G 21/1685; G03G 21/1633; G03G 21/1647; G03G 2221/1639; G03G 2221/1687; G03G 2221/169; G03G 15/2035
USPC ..... 399/320, 328, 330, 331, 122, 124; 499/693
See application file for complete search history.

(56) References Cited

U.S. PATENT DOCUMENTS

| | | | | |
|---|---|---|---|---|
| 4,428,660 | A * | 1/1984 | Matsumoto | 399/122 |
| 5,543,903 | A * | 8/1996 | Fujita et al. | 399/327 |
| 7,023,568 | B2 * | 4/2006 | Tsunekawa | 358/1.13 |
| 7,362,984 | B2 * | 4/2008 | Eom | 399/110 |
| 7,957,666 | B2 * | 6/2011 | Sato et al. | 399/107 |
| 2003/0118382 | A1 * | 6/2003 | Tomatsu | 399/328 |
| 2008/0292345 | A1 * | 11/2008 | Kang | 399/67 |
| 2010/0315658 | A1 * | 12/2010 | Niikawa | 358/1.5 |
| 2011/0243607 | A1 * | 10/2011 | Takahashi | 399/122 |

* cited by examiner

*Primary Examiner* — Daniel J Colilla
*Assistant Examiner* — John M Royston
(74) *Attorney, Agent, or Firm* — Staas & Halsey LLP

(57) ABSTRACT

An image forming apparatus includes a main body; a scanning unit disposed above the main body to be opened and closed; a paper discharging cover which is disposed on a top end of the main body below the scanning unit to open and close an opening formed on the main body and printing media are stacked; a fusing unit that is disposed behind the paper discharging cover inside the main body and includes a pressing roller and a heating roller; a first cover that is disposed above the fusing unit and guides a printing medium passed through between the pressing roller and the heating roller to the paper discharging cover; and a second cover disposed above the first cover to cover the first cover. When the second cover is opened and closed, the pressing roller and the heating roller are separated from and in contact with each other.

19 Claims, 17 Drawing Sheets

IMAGE FORMING APPARATUS

CROSS-REFERENCE TO RELATED APPLICATIONS

This application claims priority under 35 U.S.C. §119(a) to Korean Patent Application No. 10-2011-117068 filed Nov. 10, 2011 in the Korean Intellectual Property Office, the disclosure of which is incorporated herein by reference in its entirety.

BACKGROUND

1. Field

The present disclosure relates to an image forming apparatus. More particularly, the present disclosure relates to an image forming apparatus with a scanning unit having a cover structure of a fusing unit that is formed to easily remove a printing medium jammed in the fusing unit.

2. Description of the Related Art

An image forming apparatus, such as a laser composite apparatus, that forms an image by an electro photographic method and has a scanning unit has a structure of lifting the scanning unit so that an image forming cartridge can be detached from a main body of the image forming apparatus.

In the image forming apparatus having the above structure, when a jam occurs near the fusing unit during printing, the scanning unit is lifted, and then the printing medium jammed in the fusing unit is removed.

However, the fusing unit has a pressing roller and a heating roller for applying predetermined pressure and heat to the printing medium. The pressing roller presses the heating roller with a predetermined pressure. Therefore, it is not easy to remove the printing medium jammed between the pressing roller and the heating roller Accordingly, an image forming apparatus has a structure that when a paper discharging cover on which the printed printing media are stacked is lifted, the pressing roller of the fusing unit is separated from the heating roller. However, there is a problem that since the scanning unit disposed above the main body cannot be opened over 90 degrees, the opening angle of the paper discharging cover is limited by the scanning unit. Also, there is a problem that since even though the paper discharging cover is opened, a guide cover that guides the printing medium being discharged from the fusing unit to the paper discharging cover is not opened, it is not easy to remove the jammed printing medium from the fusing unit.

SUMMARY

Additional aspects and/or advantages will be set forth in part in the description which follows and, in part, will be apparent from the description, or may be learned by practice of the invention.

The present disclosure has been developed in order to overcome the above drawbacks and other problems associated with this arrangement. An aspect of the present disclosure relates to an image forming apparatus having a cover that covers a fusing unit and can be opened and closed in order to remove a jammed printing medium independently of a paper discharging cover that is opened and closed for exchanging an image forming cartridge.

The above aspect and/or other feature of the present disclosure can substantially be achieved by providing an image forming apparatus, which may include a main body; a scanning unit disposed above the main body to be opened and closed by a predetermined angle; a paper discharging cover that is disposed on a top end of the main body and below the scanning unit to open and close an opening formed on the top end of the main body and on which printing media that printing is complete are stacked; a fusing unit that is disposed behind the paper discharging cover inside the main body and includes a pressing roller and a heating roller; a first cover that is disposed above the fusing unit, and guides a printing medium passed through between the pressing roller and the heating roller to the paper discharging cover; and a second cover that is disposed above the first cover and covers the first cover; wherein when the second cover is opened, the pressing roller and the heating roller of the fusing unit are separated from each other and when the second cover is closed, the pressing roller and the heating roller of the fusing unit become in contact with each other.

The second cover may include guide elongated holes formed on opposite side surfaces thereof, and the fusing unit may include a pair of supporting brackets that supports opposite ends of the pressing roller; and decompression levers that are extended from the supporting brackets and have front ends connected with the guide elongated holes. When the second cover is closed, the front end of the decompression lever may be located at a first position so that the pressing roller comes in contact with the heating roller, and when the second cover is opened, the front end of the decompression lever may be moved from the first position to a second position so that the pressing roller is separated from the heating roller.

A stopper that limits an opening angle of the second cover may be disposed on a rear end of the second cover.

When the second cover is opened, the first cover may be opened in association with the second cover.

When the second cover is closed, the first cover may be closed.

The image forming apparatus may include a connecting unit connecting the first cover and the second cover.

The connecting unit may include a connecting link disposed on the first cover; and a connecting rail that is disposed on a bottom surface of the second cover, the connecting rail with which a front end of the connecting link is slidably connected.

The connecting unit may include two connecting units.

When the paper discharging cover closes the top end of the main body, the second cover can be opened and closed regardless of the paper discharging cover.

When the paper discharging cover is opened, the second cover may be opened by the paper discharging cover.

A first opening angle of the second cover when the second cover only is opened may be larger than a second opening angle of the second cover when the second cover is opened by the paper discharging cover.

The second cover may include at least one hooking protrusion, and the paper discharging cover may include at least one hooking portion corresponding to the at least one hooking protrusion.

When the paper discharging cover is opened, a space inside the main body which the image forming cartridge may be mounted into and separated from is exposed.

The second cover may include at least one stacking guide disposed in a front end of the second cover.

The fusing unit may include a paper discharging roller and a paper discharging idle roller to convey the printing medium passed through between the heating roller and the pressing roller to the paper discharging cover.

The image forming apparatus may include a shaft holder that is disposed at the front end of the second cover and limits wobble of the paper discharging roller.

The image forming apparatus may include a paper stack amount sensor that is disposed in the second cover and detects an amount of the printing media stacked on the paper discharging cover.

Other objects, advantages and salient features of the present disclosure will become apparent from the following detailed description, which, taken in conjunction with the annexed drawings, discloses preferred embodiments.

BRIEF DESCRIPTION OF THE DRAWINGS

These and/or other aspects and advantages of the present disclosure will become apparent and more readily appreciated from the following description of the embodiments, taken in conjunction with the accompanying drawings of which.

Throughout the drawings, like reference numerals will be understood to refer to like parts, components and structures.

DETAILED DESCRIPTION

Hereinafter, certain exemplary embodiments of the present disclosure will be described in detail with reference to the accompanying drawings.

The matters defined herein, such as a detailed construction and elements thereof, are provided to assist in a comprehensive understanding of this description. Thus, it is apparent that exemplary embodiments may be carried out without those defined matters. Also, well-known functions or constructions are omitted to provide a clear and concise description of exemplary embodiments. Further, dimensions of various elements in the accompanying drawings may be arbitrarily increased or decreased for assisting in a comprehensive understanding.

Figure 1:
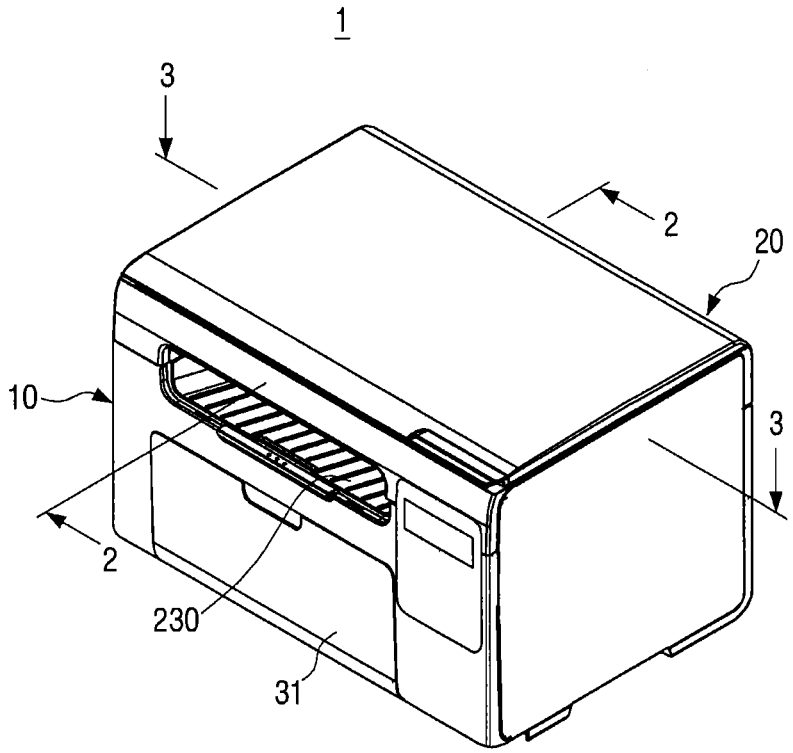
FIG. 1 is a perspective view illustrating an image forming apparatus according to an exemplary embodiment of the present disclosure.
Figure 2:
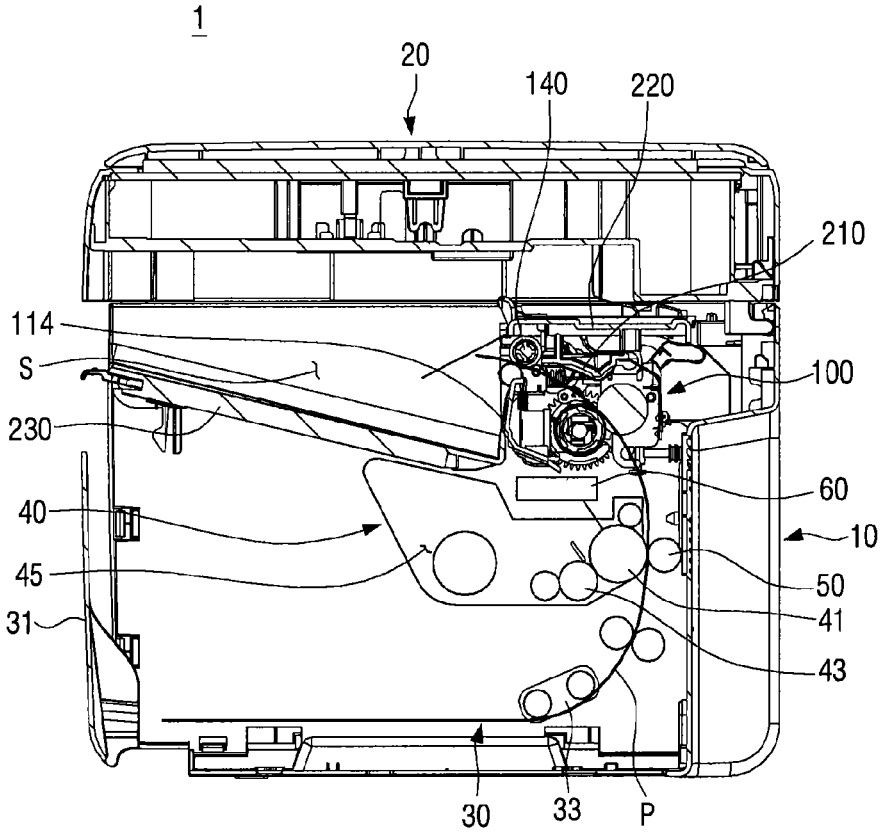
FIG. 2 is a sectional view schematically illustrating the image forming apparatus taken along a line 2-2 in FIG. 1.

FIG. 1 is a perspective view illustrating an image forming apparatus according to an exemplary embodiment of the present disclosure. FIG. 2 is a sectional view schematically illustrating the image forming apparatus taken along a line 2-2 in FIG. 1, and FIG. 3 is a sectional view illustrating the image forming apparatus taken along a line 3-3 in FIG. 1.

The present disclosure relates to an image forming apparatus that forms images by an electro photographic method and has a scanning unit as an image inputting device. More particularly, the present disclosure relates to a laser composite apparatus that can be used as at least one among a scanner, a copier, a printer, a facsimile machine depending on selection of a user.

Figure 3:
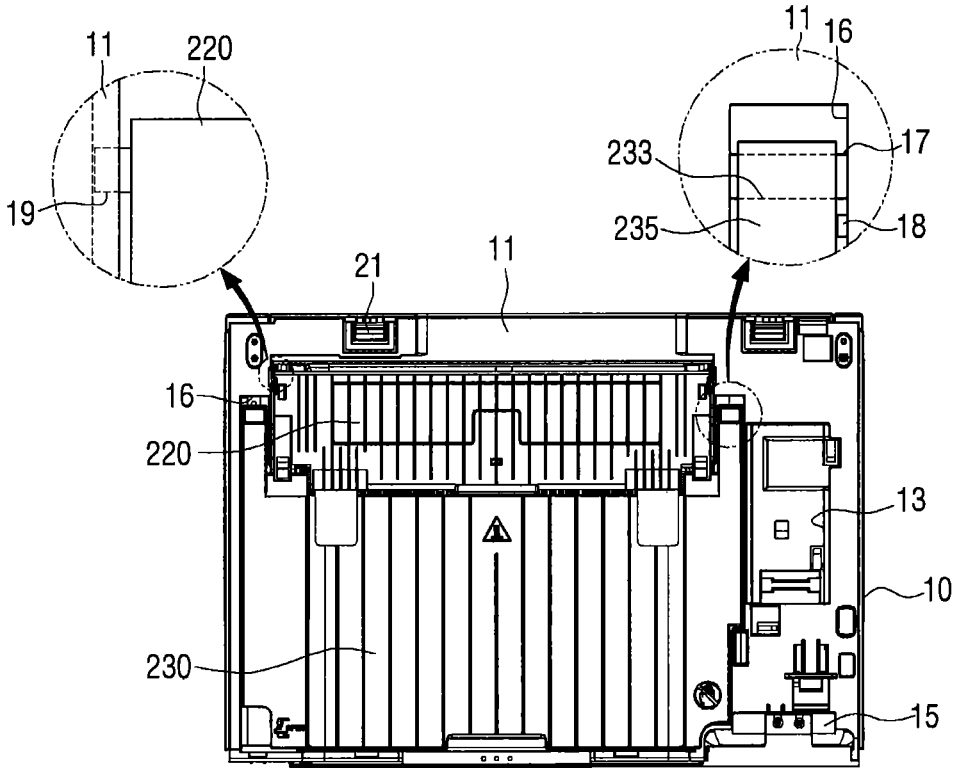
FIG. 3 is a sectional view illustrating the image forming apparatus taken along a line 3-3 in FIG. 1.

Referring to FIGS. 1 to 3, an image forming apparatus 1 according to an exemplary embodiment of the present disclosure includes a main body 10, a scanning unit 20, a printing medium feeding unit 30, an image forming cartridge 40, a fusing unit 100, a first cover 210, a second cover 220, and a paper discharging cover 230.

The main body 10 forms an appearance of the image forming apparatus 1 according to an exemplary embodiment of the present disclosure and supports and secures the scanning unit 20, the printing medium feeding unit 30, the image forming cartridge 40, the fusing unit 100, the first cover 210, the second cover 220, and the paper discharging cover 230, and the like.

The main body 10 is formed in a substantially rectangular parallelepiped shape. An upper frame 11 is disposed at a top end of the main body 10. The upper frame 11 supports the scanning unit 20, the second cover 220 and the paper discharging cover 230 to rotate within a predetermined range of angle. Also, an opening 12 (see FIG. 6) which is covered by the second cover 220 and the paper discharging cover 230 is provided in the upper frame 11. The fusing unit 100 is disposed below the second cover 220.

Figure 4:
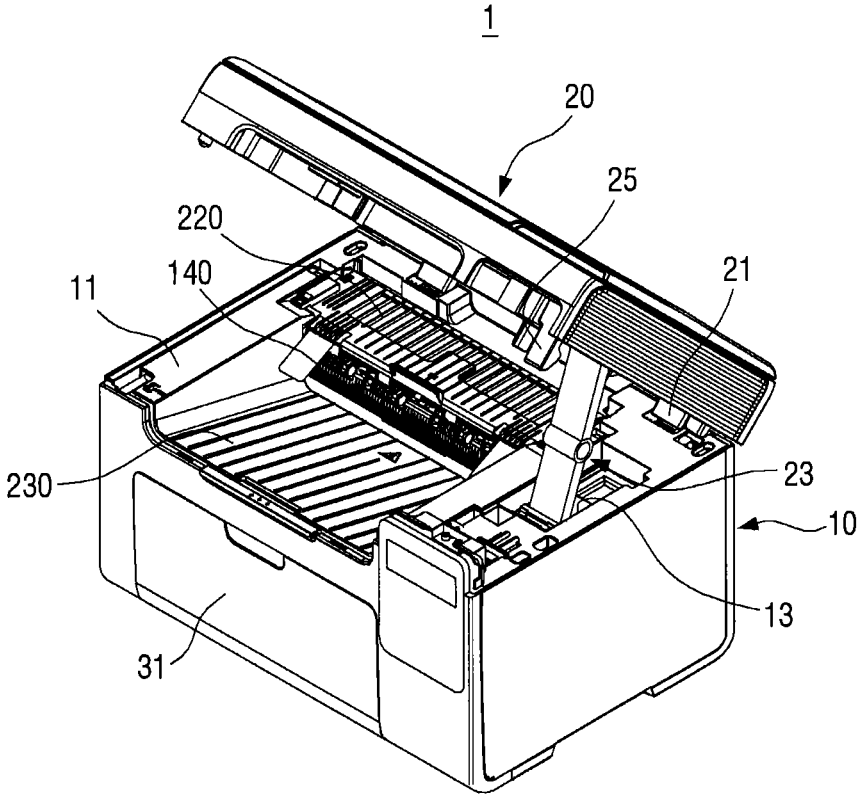
FIG. 4 is a perspective view illustrating the image forming apparatus when a scanning unit thereof is opened in FIG. 1.

The scanning unit 20 is a device that inputs images and disposed above the main body 10 to be opened and closed by a predetermined angle. For this, as illustrated in FIG. 4, the scanning unit 20 is coupled to the upper frame 11 by hinges Also, the upper frame 11 and the scanning unit 20 are connected with each other by a two-bar linkage 23. A link groove 13 that receives the two-bar linkage 23 when the scanning unit 20 is closed is provided in the upper frame 11. When the scanning unit 20 is opened, the scanning unit 20 is rotated by a predetermined angle based on hinges 21. Since the scanning unit 20 can be rotated till the two-bar linkage 23 completely gets unfolded to become the shape of the number 1, an opening angle of the scanning unit 20 is determined by the length of the two-bar linkage 23.

A hook 25 is provided in a bottom end of the scanning unit 20, and a securing groove 15 into which the hook 25 is inserted is formed in the upper frame 11 of the main body 10. Accordingly, when the scanning unit 20 is closed, the hook 25 is inserted into the securing groove 15 so that the scanning unit 20 is fixed to the main body 10.

The printing medium feeding unit 30 stores predetermined sheets of printing media P and picks up the stored printing media one by one to feed toward the transfer roller 50. The printing medium feeding unit 30 is disposed in a lower portion of the main body 10. The printing medium feeding unit 30 includes a pickup roller 33 and a printing medium feeding tray 31 that is disposed in a front surface of the main body 10. When the printing medium feeding tray 31 is opened, a space in which sheets of printing media P can be loaded is exposed. The pickup roller 33 is disposed in front of the printing medium feeding unit 30, picks up the printing media P stacked in the printing medium feeding unit 30 one by one, and feeds the picked printing medium P toward the transfer roller 50.

The image forming cartridge 40 forms a developer image corresponding to printing data and may include an image carrier 41 on which an electrostatic latent image is formed by an exposing unit 60, a developing roller 43 that supplies developer to the electrostatic latent image formed on the image carrier 41 to form a developer image, and a developer storing space 45 that accommodates developer being supplied to the developing roller 43. The image forming cartridge 40 may be detachably mounted into the main body 10. If the paper discharging cover 230 is lifted, the opening 12 of the upper frame 11 is opened so that an inner space of the main body 10 into which the image forming cartridge 40 is mounted is exposed. Accordingly, the image forming cartridge 40 can be inserted into a space above the printing medium feeding unit 30 through the opening 12 of the upper frame 11.

The transfer roller 50 is rotatably disposed in the main body 10 and faces the image carrier 41 of the image forming cartridge 40. The transfer roller 50 causes the developer image formed on the image carrier 41 to be transferred onto the printing medium P.

The fusing unit 100 fuses the transferred developer image onto the printing medium P, and is disposed in the opening 12 of the upper frame 11 behind the paper discharging cover 230. In other words, the fusing unit 100 is disposed inside the main body 10 adjacent to a rear surface of the main body 10 in which the hinges 21 of the scanning unit 20 are installed.

Figure 7:
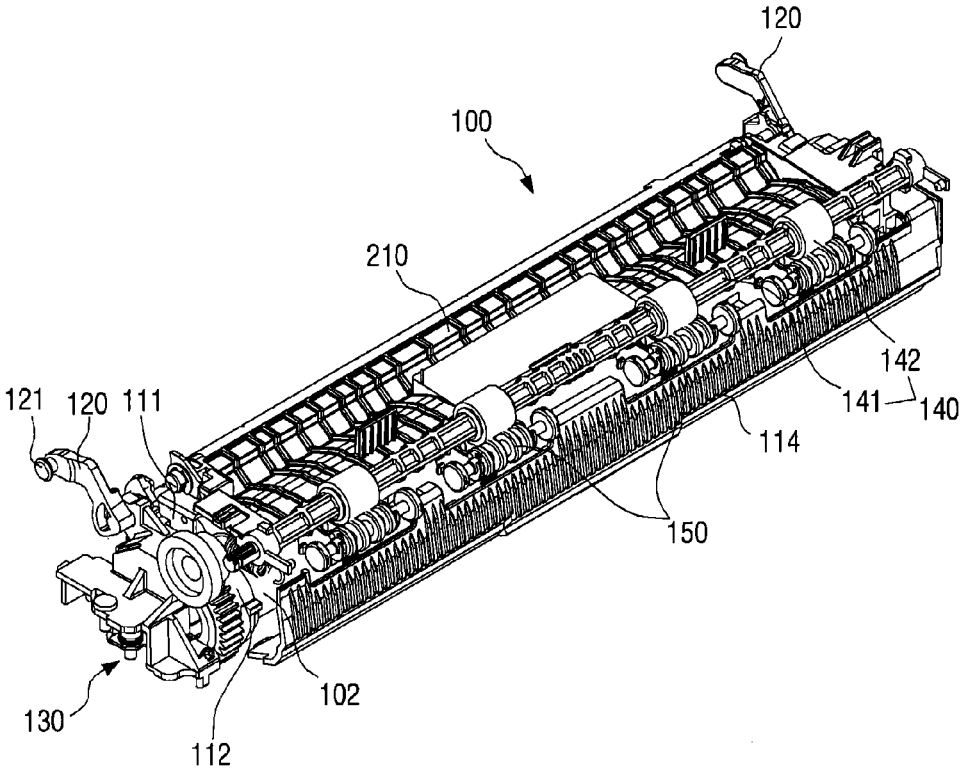
FIG. 7 is a perspective view illustrating a fusing unit of the image forming apparatus of FIG. 1 when a first cover thereof is closed.
Figure 8:
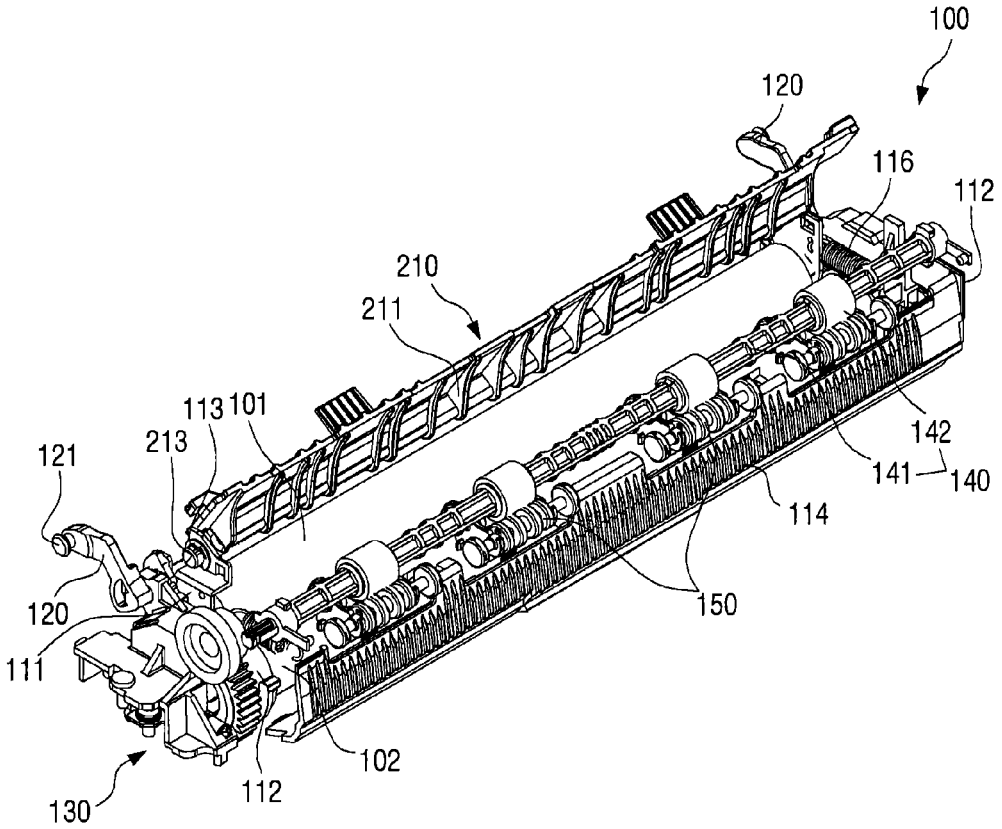
FIG. 8 is a perspective view illustrating the fusing unit of FIG. 7 when the first cover is opened.
Figure 9:
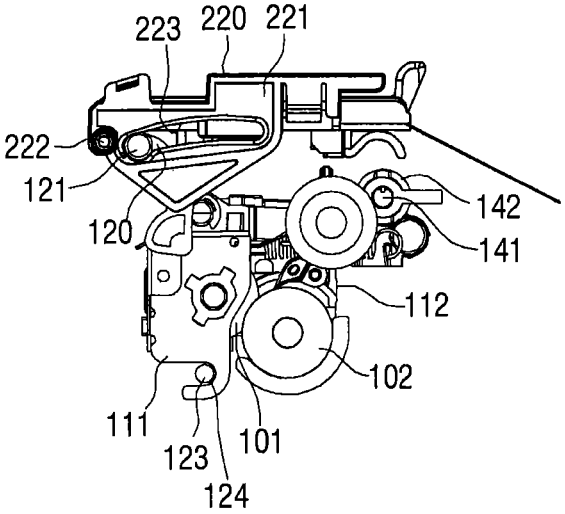
FIG. 9 is a view for explaining a relationship between the second cover and a decompression lever of a fusing unit when the second cover of the image forming apparatus of FIG. 1 is closed.

Referring to FIGS. 7 to 9, the fusing unit 100 includes a pressing roller 101, a heating roller 102, a pair of first supporting brackets 111 that can support opposite ends of the pressing roller 101, a pair of second supporting brackets 112 that can support opposite ends of the heating roller 102, and a driving portion 130 for rotating the heating roller 102. A bracket hinge groove 124 is formed at a bottom end portion of each of the pair of first supporting brackets 111. A bracket hinge shaft 123 that is inserted into the bracket hinge groove 124 of the first supporting bracket 111 is formed at a bottom end portion of each of the pair of second supporting brackets 112. Accordingly, the first supporting brackets 111 can swing a predetermined angle with respect to the second supporting brackets 112 based on the bracket hinge shafts 123 of the bottom end portion thereof.

A decompression lever 120 that is coupled to the second cover 220 is disposed at a top end portion of the first supporting brackets 111. If a force is applied to the decompression lever 120, the first supporting brackets 111 can swing a predetermined angle based on the bracket hinge shaft 123. If the first supporting brackets 111 swings a predetermined angle based on the bracket hinge shaft 123, the pressing roller 101 is separated from the heating roller 102. A pressure member 116 that causes the pressing roller 101 to press the heating roller 102 with a predetermined pressure is disposed between the first supporting bracket 111 and the second supporting bracket 112. A tension coil spring may be used as the pressure member 116.

A paper discharging roller 140 and a paper discharging idle roller 150 may be disposed integrally with the fusing unit 100. In other words, as illustrated in FIGS. 7 and 8, opposite ends of the paper discharging roller 140 are rotatably supported by the second supporting brackets 112. The paper discharging roller 140 can receive power from the above-described driving portion 130 so as to rotate. The paper discharging roller 140 is configured of a paper discharging roller shaft 141 having opposite ends supported by the second supporting brackets 112 and a plurality of rollers 142 installed on the paper discharging roller shaft 141. The paper discharging idle roller 150 is disposed to include the number of idle rollers corresponding to the plurality of rollers 142 of the paper discharging roller 140. The paper discharging idle roller 150 is disposed at a top end of a paper discharging wall 114 that is disposed between the pair of second supporting brackets 112 and forms a paper discharging space S in which the discharged printing medium P is stacked along with the paper discharging cover 230. Accordingly, the fusing unit 100, as illustrated in FIGS. 2 and 4, is disposed in the main body 10 so that the paper discharging wall 114 faces the paper discharging cover 230.

The first cover 210 is disposed above the fusing unit 100, and guides the printing medium P passing through between the heating roller 102 and the pressing roller 101 to enter between the paper discharging roller 140 and paper discharging idle roller 150. The first cover 210 is formed in a substantially rectangular shape to cover above the heating roller 102 and the pressing roller 101 and is disposed in the pair of first supporting brackets 111 so that the first cover 210 can swing a predetermined angle with respect to the heating roller 102 and the pressing roller 101. For this, a first cover hinge shaft 213 is formed on an end portion of each of opposite side surfaces of the first cover 210 and a first cover hinge hole 113 is formed on each of the pair of first supporting brackets 111. As a result, the first cover 210 can pivot a predetermined angle with respect to the first supporting brackets 111 based on the first cover hinge shaft 213.

A plurality of guide ribs 211 is formed by a predetermined interval on an inner surface of the first cover 210. The plurality of guide ribs 211 is formed to guide a front end of the printing medium P passing through between the pressing roller 101 and the heating roller 102 to between the paper discharging roller 140 and the paper discharging idle roller 150. As a result, the front end of the printing medium P passed through between the pressing roller 101 and the heating roller 102 is entered into between the paper discharging roller 140 and the paper discharging idle roller 150 by the plurality of guide ribs 211 of the first cover 210.

Figure 13:
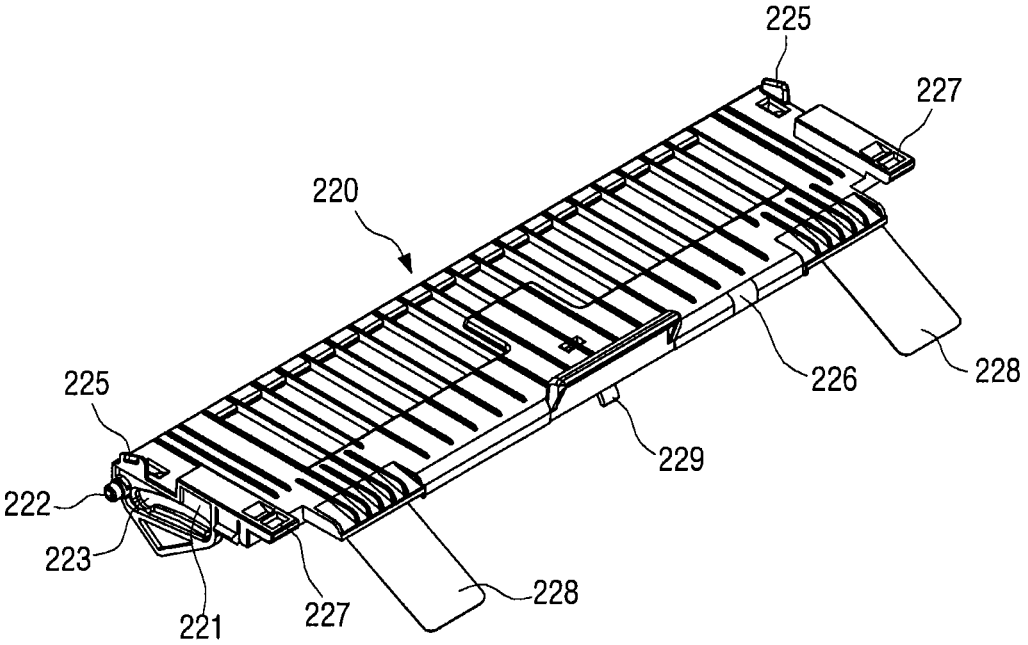
FIG. 13 is a perspective view illustrating a second cover of the image forming apparatus of FIG. 1.
Figure 14:
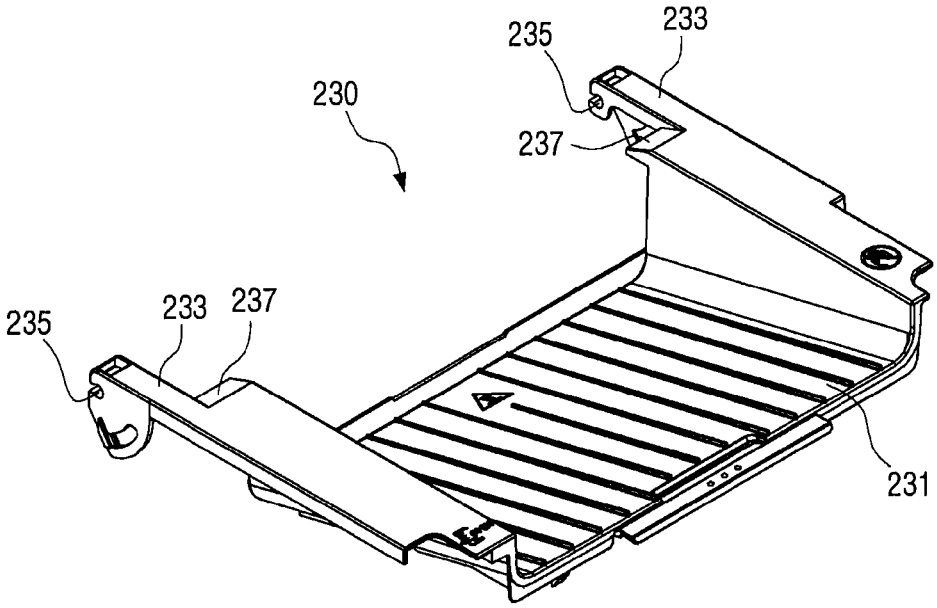
FIG. 14 is a perspective view illustrating a paper discharging cover of the image forming apparatus of FIG. 1.

The second cover 220 is disposed above the first cover 210 in the upper frame 11 of the main body 10 to selectively cover the first cover 210. Also, the second cover 220 is formed so that when the second cover 220 is opened the pressing roller 101 and the heating roller 102 of the fusing unit 100 are separated from each other, and when the second cover 220 is closed the pressing roller 101 and the heating roller 102 of the fusing unit 100 become in contact with each other. The second cover 220 is formed in a substantially rectangular shape and may have a size to cover both the first cover 210 and the paper discharging roller 140. Referring to FIG. 13, a second cover hinge shaft 222 is formed on one end of each of opposite side surfaces of the second cover 220. Referring to FIG. 3, second cover hinge holes 12 in which the second cover hinge shafts 222 are inserted are provided in the upper frame 11. Accordingly, if the second cover hinge shafts 222 are inserted into the second cover hinge holes 12 of the upper frame 11, the second cover 220 can swing a predetermined angle with respect to the upper frame 11 based on the second cover hinge shafts 222.

A guide elongated hole 223 into which a protrusion 121 formed on a front end of the decompression lever 120 extended from each of the pair of first supporting brackets 111 is inserted is formed on each of opposite side surfaces 221 of the second cover 220. The guide elongated holes 223 are formed so that when the second cover 220 is maximally swung upward and opens above the first cover 210, the heating roller 102 and the pressing roller 101 are separated from each other thereby. If the heating roller 102 and the pressing roller 101 are separated from each other, pressure between the heating roller 102 and the pressing roller 101 is removed. As a result, the printing medium P jammed between the heating roller 102 and the pressing roller 101 can be easily removed.

Figure 10:
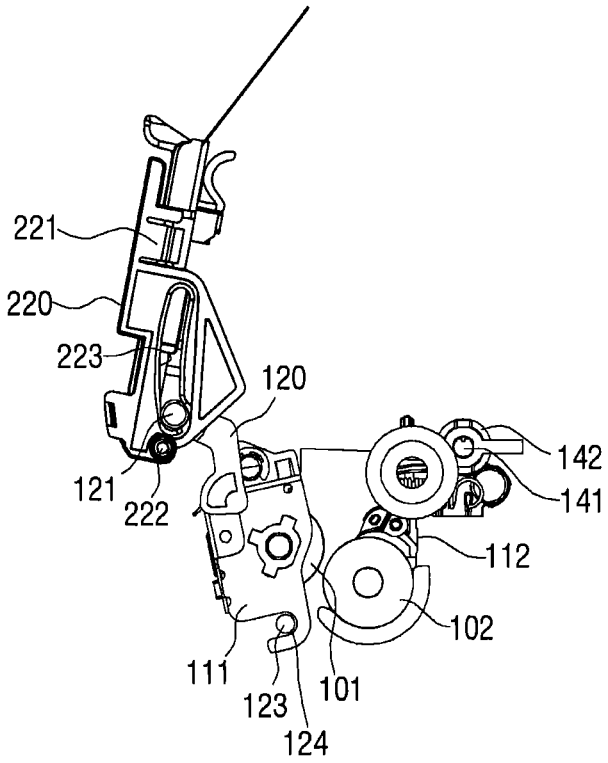
FIG. 10 is a view for explaining a relationship between the second cover and a decompression lever of a fusing unit when the second cover of the image forming apparatus of FIG. 1 is opened.

For this, the guide elongated holes 223 are formed so that when the second cover 220 is maximally rotated upward based on the second cover hinge shafts 12 of the upper frame 11, the guide elongated holes 223 applies force to the decompression lever 120 and then, as illustrated in FIG. 10, the first supporting brackets 111 are rotated in a counterclockwise direction based on the bracket hinge shafts 123. When the second cover 220 is closed, the protrusion 121 of the decompression lever 120 is located at a first position of the guide elongated hole 223 of the second cover 220 so that the heating roller 102 and the pressing roller 101 are in contact with each other. When the second cover 220 is opened, the protrusion 121 of the decompression lever 120 is moved from the first position of the guide elongated hole 223 of the second cover 220 to a second position thereof so that the heating roller 102 and the pressing roller 101 are separated from each other. After that, if the second cover 220 is closed, the protrusion 121 of the decompression lever 120 is moved from the second position of the guide elongated hole 223 to the first position thereof. As a result, since the force which the guide elongated holes 223 of the second cover 220 is applying to the decompression lever 120 is removed, the first supporting brackets 111 are rotated toward the second supporting brackets 112 based on the bracket hinge shaft 123 by the pressure member 116. As a result, since the pressing roller 101 comes in contact with and applies a predetermined pressure to the heating roller 102, the developer image transferred onto the printing medium P is fused by the fusing unit 100.

Figure 16:
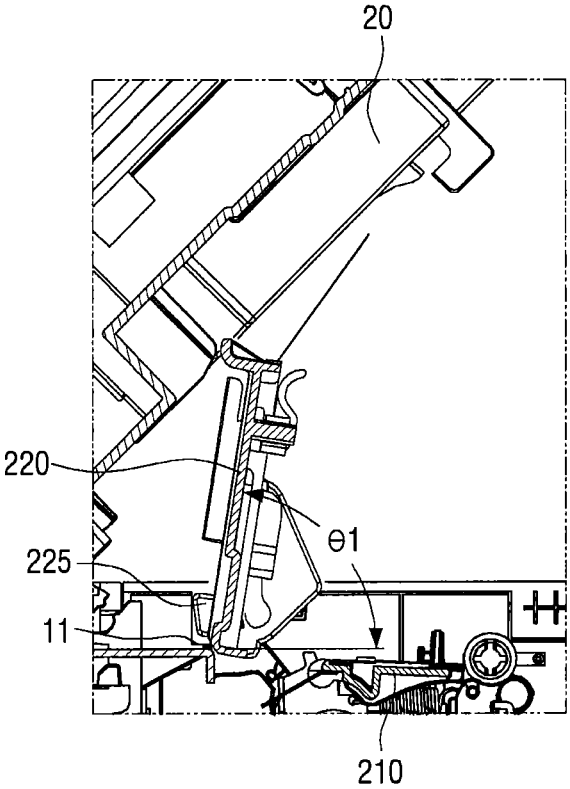
FIG. 16 is a side view illustrating a first opening angle of the second cover when the second cover only is opened in the image forming apparatus of FIG. 1.

Further, a stopper 225 for limiting the rotation angle of the second cover 220 may be disposed on a top surface for the second cover 220. In an exemplary embodiment of the present disclosure, as illustrated in FIG. 13, two stoppers 225 are formed to be extended upwardly from opposite side surfaces 221 of the second cover 220. When the second cover 220 is opened, the two stoppers 225 are interfered with the upper frame 11, thereby limiting an opening angle of the second cover 220. FIG. 16 illustrates an angle between the second cover 220 and the upper frame 11 when the second cover 220 is rotated maximally upwardly, namely, a first opening angle θ1 of the second cover 220.

On the other hand, FIG. 13 illustrates only one guide elongated hole 223 and one second cover hinge shaft 222 formed on one side surface 221 of the second cover 220; however, the same guide elongated hole 223 and second cover hinge shaft 222 are formed on the other side surface 221 of the second cover 220.

In addition, as illustrated in FIG. 13, two hooking protrusions 227 may be formed at a front end of the second cover 220. The two hooking protrusions 227 are formed adjacent to opposite side surfaces 221 of the second cover 220. The hooking protrusions 227 are formed so that when the paper discharging cover 230 is opened upwardly, the second cover 220 can be opened in association with the paper discharging cover 230.

Further, at least one stacking guide 228 may be disposed at the front end of the second cover 220. The stacking guide 228 guides the printing medium P that is being discharged from between the paper discharging roller 140 and the paper discharging idle roller 150 below the second cover 220 to fall down on the paper discharging cover 230. As illustrated in FIG. 13, two stacking guides 228 may be disposed by a predetermined interval at the front end of the second cover 220 to contact and guide two areas adjacent to opposite corners of the printing medium P. Also, the stacking guides 228 may be formed of a flexible film.

Figure 15:
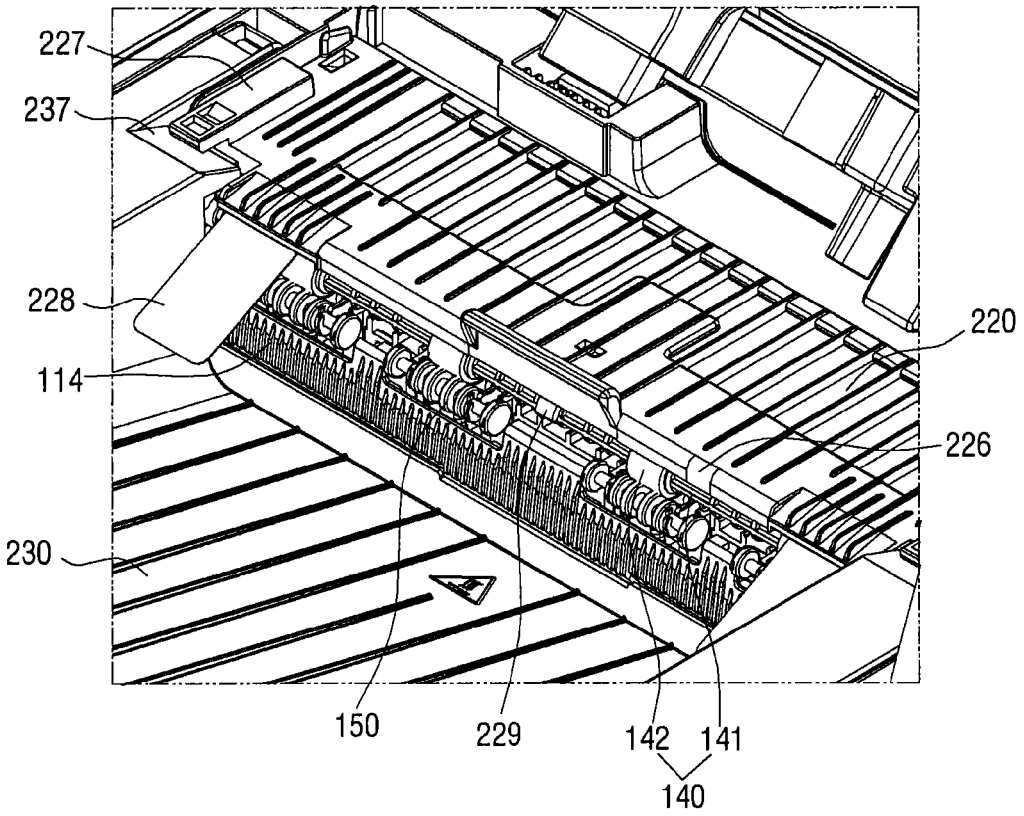
FIG. 15 is a partial perspective view illustrating a relationship among the fusing unit, the second cover and the paper discharging cover in the image forming apparatus of FIG. 1.

Additionally, a shaft holder 229 may be formed at a position corresponding to the shaft 141 of the paper discharging roller 140 on a bottom surface of the second cover 220. As illustrated in FIG. 15, the shaft holder 229 is disposed close to an approximate center portion of the shaft 141 of the paper discharging roller 140 so as to limit wobble of the shaft 141 when the paper discharging roller shaft 141 is rotated. Therefore, the shaft holder 229 may be formed in a curved plate that is bent with a curvature corresponding to a diameter of the shaft 141 of the paper discharging roller 140.

In addition, a paper stack amount sensor 226 for detecting the amount of printing media P stacked on the top surface of the paper discharging cover 230 may be disposed in the second cover 220. In other words, the paper stack amount sensor 226 measures a distance to the uppermost printing medium in the printing media P stacked on the top surface of the paper discharging cover 230, and when the distance is less than a predetermined value, the paper stack amount sensor 226 sends a signal to a control portion (not illustrated) for the image forming apparatus 1 to stop printing.

Although not illustrated, as other exemplary embodiment of the present disclosure, the second cover 220 may be formed to operate in association with the scanning unit 20. For example, the second cover 220 is formed so that when the scanning unit 20 is opened the second cover 220 is opened, and when the scanning unit 20 is closed the second cover 220 is closed.

The paper discharging cover 230 is disposed at the top end of the main body 10 and below the scanning unit 20 to open and close the opening 12 of the top end of the main body 10. In a case of the present exemplary embodiment, the paper discharging cover 230 is disposed in the upper frame 11 by hinges to selectively open or close the opening 12 of the upper frame 11 in order to expose an inner space of the main body 10 which the image forming cartridge 40 is mounted into or separated from. The paper discharging cover 230 is further formed to have the paper discharging space S in which the printing media P that printing was complete and which are discharged from between the paper discharging roller 140 and the paper discharging idle roller 150 are stacked. Therefore, the paper discharging cover 230 is disposed in front of the fusing unit 100.

Also, the paper discharging cover 230 and the second cover 220 as described above are formed as separate parts. As a result, the paper discharging cover 230 and the second cover 220 can individually operate. In other words, when the paper discharging cover 230 closes the top end of the main body 10, the second cover 220 can open and close above the first cover 210 regardless of the paper discharging cover 230.

Referring to FIGS. 3, 4, 6 and 14, the paper discharging cover 230 includes a stacking portion 231 that covers the opening 12 of the upper frame 11 of the main body 10 and forms the paper discharging space S in which the printing media P are stacked the and two arms 233 projecting from opposite side surfaces of the stacking portion 231. The two arms 233 are inserted into two paper discharging cover grooves 16 formed on the top surface of the upper frame 11. A paper discharging cover hinge shaft 17 is formed in each of the two paper discharging cover grooves 16. A paper discharging cover hinge groove 235 in which the paper discharging cover hinge shaft 17 is inserted is formed in the front end of each of the two arms 233. As a result, if the arms 233 of the paper discharging cover 230 are inserted into the paper discharging cover grooves 16, the paper discharging cover hinge shafts 17 are inserted in the paper discharging cover hinge grooves 235 so that the paper discharging cover 230 can swing a predetermined angle based on the paper discharging cover hinge shafts 17. Also, a fixing protrusion 18 is formed on a side surface of the paper discharging cover groove 16 to press the side surface of the arm 233 of the paper discharging cover 230. As a result, when the paper discharging cover 230 is lifted at a certain angle based on the paper discharging cover hinge shaft 17, the paper discharging cover 230 may be fixed by the fixing protrusion 18 thereby maintaining the open state. If a user applies a predetermined force to the paper discharging cover 230, the paper discharging cover 230 is restored to a position to cover the opening 12 of the upper frame 11.

In addition, the paper discharging cover 230 may be formed so that the second cover 220 is opened and closed in association with open-closing operation of the paper discharging cover 230. In other words, the paper discharging cover 230 is formed so that when the user opens the paper discharging cover 230, the second cover 220 is opened by the paper discharging cover 230, and when the user closes the paper discharging cover 230, the second cover 220 is closed by the paper discharging cover 230. For this, the second cover 220 has the hooking protrusions 227 as described above, and the paper discharging cover 230, as illustrated in FIGS. 3 and 15, has the hooking portions 237 corresponding to the hooking protrusions 227 of the second cover 220. In a case of this exemplary embodiment, since the second cover 220 has two hooking protrusions 227, the paper discharging cover 230 is also formed to have two hooking portions 237.

Figure 17:
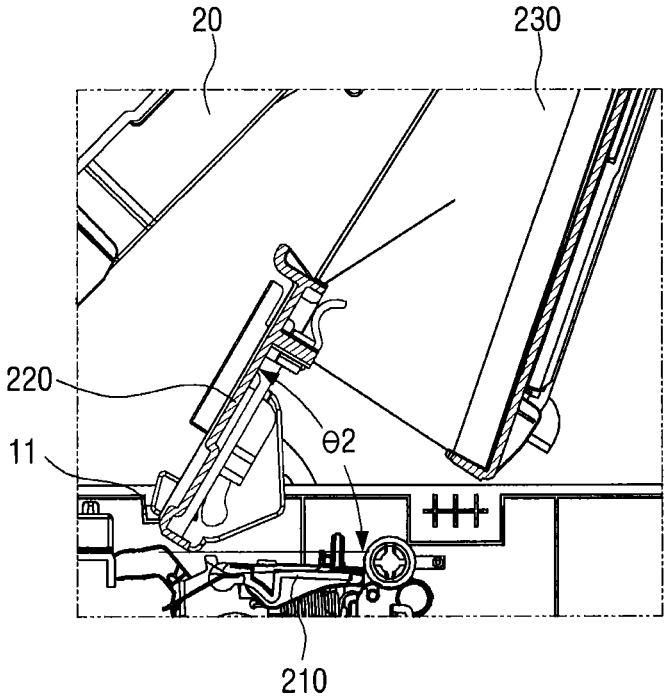
FIG. 17 is a side view illustrating a second opening angle of the second cover when the paper discharging cover is opened in the image forming apparatus of FIG. 1

FIG. 17 illustrates the second cover 220 opened by the paper discharging cover 230. Referring to FIG. 17, an opening angle of the second cover 220 when the second cover 220 is opened by the paper discharging cover 230, that is, a second opening angle θ2 of the second cover 220 is smaller than the first opening angle θ1 of the second cover 220 when, as illustrated in FIG. 16, the paper discharging cover 230 is closed and only the second cover 220 is opened. Accordingly, when the second cover 220 is opened by the paper discharging cover 230, the second cover 220 is not fully opened. As a result, if the paper discharging cover 230 is closed, the second cover 220 is restored to its original position to cover the top of the first cover 210 by the resilience of the pressure member 116 of the fusing unit 100.

In the above explanation, the second cover 220 is operated separately from the first cover 210. However, alternatively, the first cover 210 may be formed to be opened and closed in association with the open-closing operation of the second cover 220. In other words, the first cover 210 is formed so that when the user opens the second cover 220, the first cover 210 is opened in association with the second cover 220, and when the user closes the second cover 220, the first cover 210 also is closed in association with the second cover 220.

Figure 11:
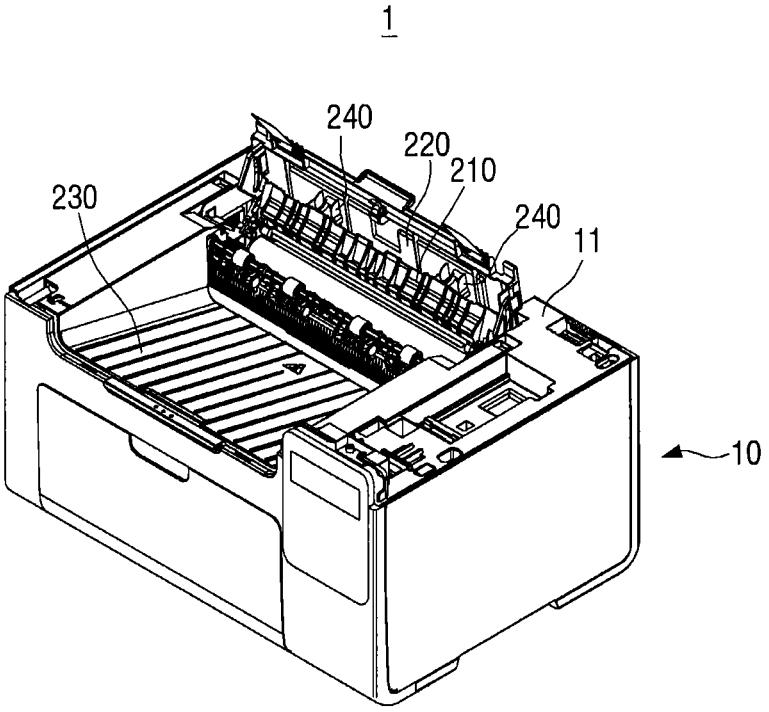
FIG. 11 is a perspective view illustrating the image forming apparatus of FIG. 1 a first cover of which is opened in association with a second cover when the second cover is opened.
Figure 12:
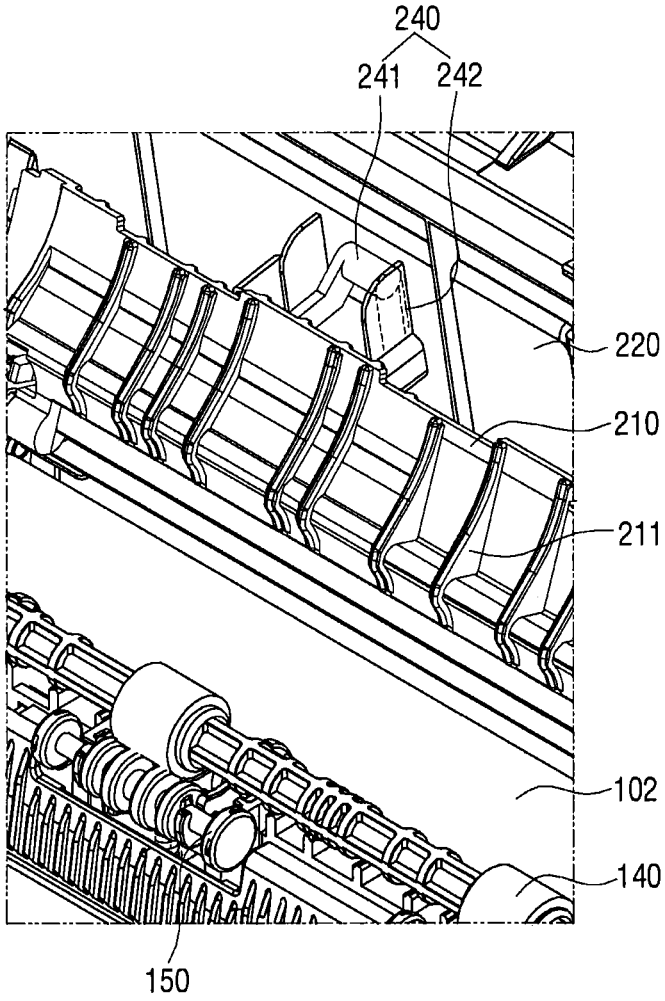
FIG. 12 is a partial perspective view illustrating a connecting unit that connects the first cover and the second cover in the image forming apparatus of FIG. 11.

In the structure as described above, a connecting unit 240 may be disposed between the first cover 210 and the second cover 220. FIG. 11 illustrates the image forming apparatus 1 from which the scanning unit 20 is removed for clearly showing the connecting unit 240 that connects the first cover 210 and the second cover 220. Referring to FIGS. 11 and 12, the connecting unit 240 may include a connecting link 241 disposed on the top surface of the first cover 210 and a connecting rail 242 disposed on the bottom surface of the second cover 220. The connecting link 241 is formed to extend from the top surface of the first cover 220 to the second cover 220 and a front end of the connecting link 241 is slidably connected with the connecting rail 242. One connecting unit 240 may be disposed; however, two connecting units 240 may be disposed so that the first cover 210 is smoothly operated in association with the second cover 220. FIG. 11 illustrates the image forming apparatus 1 having two connecting units 240 disposed between the first cover 210 and the second cover 220.

In the image forming apparatus 1 having the above-described structure, when the second cover 220 is opened, the connecting rail 242 disposed on the bottom surface of the second cover 220 is moved upwardly. If the connecting rail 242 is moved upwardly, the connecting link 241 connected with the connecting rail 242 receives force upwardly. As a result, the first cover 210 on which the connecting link 241 is disposed is moved upwardly based on the first cover hinge shaft 213 to open the top side of the heating roller 102 and the pressing roller 101. Contrary, when the second cover 220 is closed, the connecting rail 242 is moved downwardly so that the connecting link 241 also receives force downwardly. As a result, the first cover 210 on which the connecting link 241 is disposed is moved downwardly based on the first cover hinge shaft 213 to close the top side of the heating roller 102 and the pressing roller 101.

Hereinafter, operation of the image forming apparatus according to an exemplary embodiment of the present disclosure with reference to accompanying drawings.

Firstly, when a printing medium P is jammed in the fusing unit 100 during printing, a process of removing the jammed printing medium will be explained.

When the image forming apparatus 1 according to an exemplary embodiment of the present disclosure starts to print, a printing medium P of the printing medium feeding unit 30 is picked up and fed to the transfer roller 50. Then, a developer image formed on the image carrier 41 of the image forming cartridge 40 is transferred onto the printing medium P by the transfer roller 50. The printing medium P on which the developer image is transferred is conveyed to the fusing unit 100 and passes through between the pressing roller 101 and heating roller 102. As a result, the developer image is fused on the printing medium P by heat and pressure being applied by the heating roller 102 and the pressing roller 101. The printing medium P that passed through between the pressing roller 101 and the heating roller 102 is entered into between the paper discharging roller 140 and the paper discharging idle roller 150 by the plurality of guide ribs 211 formed on the bottom surface of the first cover 210. The printing medium P being discharged by the paper discharging roller 140 is guided by the two stacking guides 228 disposed in the front end of the second cover 220, and then falls down on the stacking portion 231 of the paper discharging cover 230. While the paper discharging roller 140 rotates to discharge the printing medium P, the middle portion of the shaft 141 of the paper discharging roller 140 is being supported by the shaft holder 229 so that wobble of the shaft 141 is minimized.

During printing if a jam of the printing medium P occurs in the fusing unit 100, the user makes the scanning unit 20 turn upwardly by a predetermined angle as illustrated in FIG. 4. At this time, since there is the two-bar linkage 23 between the scanning unit 20 and the main body 10, the rotating angle of the scanning unit 20 is limited and the scanning unit 20 can remain open.

Figure 5:
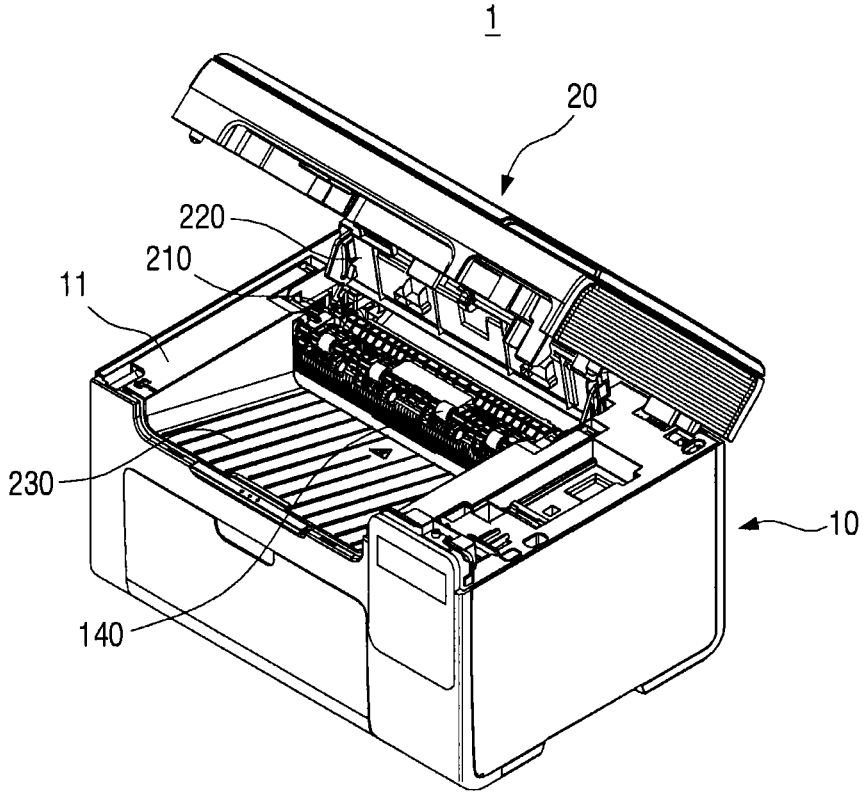
FIG. 5 is a perspective view illustrating the image forming apparatus when a second cover thereof is opened in FIG. 4.

Next, the user lifts the second cover 220 upwardly as illustrated in FIG. 5. In FIG. 5, the two-bar linkage 23 is removed for clearly showing the second cover 220. As a result, the second cover 220 is rotated based on the second cover hinge shaft 222. When the stopper 225 of the second cover 220 is interfered with the upper frame 11, the second cover 220 is fully opened to expose the first cover 210. In addition, when the second cover 220 is opened, the protrusion 121 of the decompression lever 120 that is inserted in the guide elongated hole 223 of the second cover 220 is moved from the first position to the second position so as to apply force to the decompression lever 120. As a result, the first supporting brackets 111 on which the decompression lever 120 is disposed is rotated in the counterclockwise direction based on the bracket hinge shaft 123 so that the pressing roller 101 supported by the pair of first supporting brackets 111 is separated from the heating roller 102 (see FIG. 10).

After that, the user lifts the first cover 210 upwardly to open the pressing roller 101 and heating roller 102 of the fusing unit 100. Accordingly, the user can easily remove the jammed printing medium P positioned between the pressing roller 101 and the heating roller 102 that are separated from each other.

After the user removed the jammed printing medium P, the user closes the first cover 210, and then closes the second cover 220. When the second cover 220 is closed, the protrusion 121 of the decompression lever 120 that is connected with the guide elongated holes 223 of the second cover 220 moves from the second position to the first position. As a result, since the force that is applied to the decompression lever 120 by the guide elongated holes 223 of the second cover 220 is removed, the first supporting brackets 111 on which the decompression lever 120 is disposed receive force toward the second supporting brackets 112 by the pressure member 116. As a result, the first supporting brackets 111 is rotated in the clockwise direction based on the bracket hinge shaft 123 so that, as illustrated in FIG. 9, the pressing roller 101 presses the heating roller 102 with a predetermined pressure.

After that, after the user closes the scanning unit 20, the image forming apparatus 1 is ready to print.

In the above description, the first cover 210 and the second cover 220 are individually rotated. However, if the first cover 210 and the second cover 220 are formed to operate in association with each other as illustrated in FIG. 11, when the second cover 220 is opened, the first cover 210 is operated in association with the second cover 220 by the connecting unit 240 so that the first cover 210 is opened along with the second cover 220. Further, when the second cover 220 is closed, the first cover 210 also is closed by the second cover 220. Therefore, the user does not need to open the first cover 210 after opening the second cover 220 and to close the first cover 210 since if the user closes only the second cover 220, the first cover 210 is also closed. Therefore, it is convenient to remove the jammed printing medium P.

Next, a process of replacing the image forming cartridge 40 mounted in the image forming apparatus 1 will be explained.

Firstly, the user makes the scanning unit 20 rotate upwardly by a certain angle as illustrated in FIG. 4. At this time, since there is the two-bar linkage 23 between the scanning unit 20 and the main body 10, the rotating angle of the scanning unit 20 is limited and the scanning unit 20 can remain open.

Figure 6:
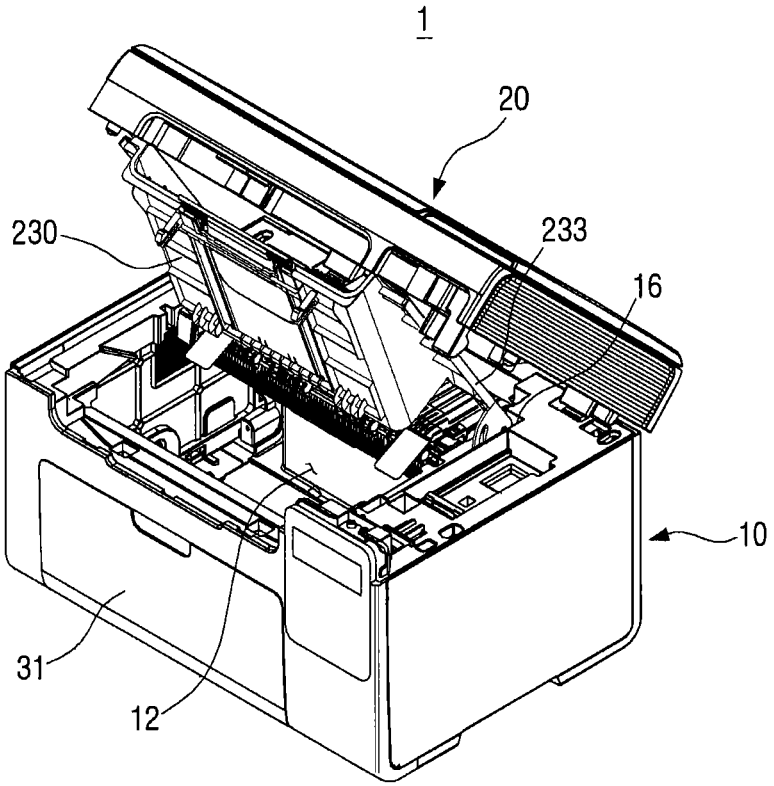
FIG. 6 is a perspective view illustrating the image forming apparatus when a paper discharging cover thereof is opened in FIG. 4.

After that, the user lifts the paper discharging cover 230 upwardly as illustrated in FIG. 6. In FIG. 6, the two-bar linkage 23 is removed for clearly showing the paper discharging cover 230. As a result, the paper discharging cover 230 is rotated upwardly based on the paper discharging cover hinge shaft 17 to expose the opening 12 of the upper frame 11. Since the hooking protrusions 227 of the second cover 220 are positioned on the hooking portions 237 of the paper discharging cover 230, when the paper discharging cover 230 is rotated upwardly, the second cover 220 also is rotated upwardly along with the paper discharging cover 230. As a result, the second cover 220 also is opened upwardly by a predetermined angle. Then, the user can separate the image forming cartridge 40 from the main body 10 through the opening 12 of the upper frame 11.

After that, the user mounts a new image forming cartridge 40 into the inside of the main body 10 through the opening 12 of the upper frame 11. Then, the user closes the paper discharging cover 230. When the paper discharging cover 230 is closed, the second cover 220 that was opened along with the paper discharging cover 230 is closed by the pressure member 116 of the fusing unit 100.

After that, after the user closes the scanning unit 20, the image forming apparatus 1 is ready to print.

With an image forming apparatus according to an exemplary embodiment of the present disclosure as described above, since a second cover is formed separately from a paper discharging cover and when the second cover is opened, pressing pressure of a fusing unit is removed and a first cover that guides a printing medium being discharged from between a pressing roller and a heating roller can be opened, it is convenient to remove a printing medium jammed in the fusing unit.

In addition, if a first cover is formed to operate in association with a second cover, when the second cover is opened, pressure between a pressing roller and a heating roller is removed and the first cover is opened along with the second cover. Therefore, it is convenient to remove a printing medium jammed in a fusing unit.

In addition, with an image forming apparatus according to an exemplary embodiment of the present disclosure, since when a paper discharging cover is opened, an opening through which an image forming cartridge is mounted and separated is opened, it is easy to replace the image forming cartridge.

While the embodiments of the present disclosure have been described, additional variations and modifications of the embodiments may occur to those skilled in the art once they learn of the basic inventive concepts. Therefore, it is intended that the appended claims shall be construed to include both the above embodiments and all such variations and modifications that fall within the spirit and scope of the inventive concepts.

What is claimed is:

1. An image forming apparatus comprising:

a main body;

a scanning unit disposed above the main body to be opened and closed by a predetermined angle;

a paper discharging cover that is disposed on a top end of the main body and below the scanning unit to open and close an opening formed on the top end of the main body and on which printing media that printing is complete are stacked;

a fusing unit that is disposed behind the paper discharging cover inside the main body and includes a pressing roller and a heating roller;

a first cover that is disposed above the fusing unit, and guides a printing medium passed through between the pressing roller and the heating roller to the paper discharging cover; and a second cover that is disposed above the first cover and covers the first cover;

wherein when the second cover is opened, the pressing roller and the heating roller of the fusing unit are separated from each other and when the second cover is closed, the pressing roller and the heating roller of the fusing unit become in contact with each other.

2. The image forming apparatus of claim 1, wherein the second cover comprises guide elongated holes formed on opposite side surfaces thereof, and the fusing unit comprises;

a pair of supporting brackets that supports opposite ends of the pressing roller; and decompression levers that are extended from the supporting brackets and have front ends connected with the guide elongated holes; and wherein when the second cover is closed, the front end of the decompression lever is located at a first position so that the pressing roller comes in contact with the heating roller, and when the second cover is opened, the front end of the decompression lever is moved from the first position to a second position so that the pressing roller is separated from the heating roller.

3. The image forming apparatus of claim 2, wherein a stopper that limits an opening angle of the second cover is disposed on a rear end of the second cover.

4. The image forming apparatus of claim 1, wherein when the second cover is opened, the first cover is opened in association with the second cover.

5. The image forming apparatus of claim 4, wherein when the second cover is closed, the first cover is closed.

6. The image forming apparatus of claim 4, further comprising:

a connecting unit connecting the first cover and the second cover.

7. The image forming apparatus of claim 6, wherein the connecting unit comprises;

a connecting link disposed on the first cover; and a connecting rail that is disposed on a bottom surface of the second cover, the connecting rail with which a front end of the connecting link is slidably connected.

8. The image forming apparatus of claim 6, further comprising at least two connecting units.

9. The image forming apparatus of claim 1, wherein when the paper discharging cover closes the top end of the main body, the second cover can be opened and closed regardless of the paper discharging cover.

10. The image forming apparatus of claim 9, wherein when the paper discharging cover is opened, the second cover is opened by the paper discharging cover.

11. The image forming apparatus of claim 10, wherein a first opening angle of the second cover when the second cover only is opened is larger than a second opening angle of the second cover when the second cover is opened by the paper discharging cover.

12. The image forming apparatus of claim 9, wherein the second cover comprises at least one hooking protrusion, and the paper discharging cover comprises at least one hooking portion corresponding to the at least one hooking protrusion.

13. The image forming apparatus of claim 1, wherein when the paper discharging cover is opened, a space inside the main body which the image forming cartridge is mounted into and separated from is exposed.

14. The image forming apparatus of claim 1, wherein the second cover comprises at least one stacking guide disposed in a front end of the second cover.

15. The image forming apparatus of claim 1, wherein the fusing unit comprises a paper discharging roller and a paper discharging idle roller to convey the printing medium passed through between the heating roller and the pressing roller to the paper discharging cover.

16. The image forming apparatus of claim 15, further comprising:

a shaft holder that is disposed at the front end of the second cover and limits wobble of the paper discharging roller.

17. The image forming apparatus of claim 1, further comprising:

a paper stack amount sensor that is disposed in the second cover and detects an amount of the printing media stacked on the paper discharging cover.

18. An image forming apparatus comprising:

a main body;

a scanning unit disposed above the main body to be opened and closed by a predetermined angle;

a paper discharging cover that is disposed on a top end of the main body and below the scanning unit to open and close an opening formed on the top end of the main body and on which printing media that printing is complete are stacked;

a fusing unit that is disposed behind the paper discharging cover inside the main body and includes a pressing roller and a heating roller;

a first cover that is disposed above the fusing unit, and guides a printing medium passed through between the pressing roller and the heating roller to the paper discharging cover; and a second cover that is located in the main body above the first cover and covers the first cover;

wherein the second cover can be open independently of the paper discharging cover and the second cover can be opened simultaneously with the opening of the paper discharging cover;

wherein when the second cover is opened, the pressing roller and the heating roller of the fusing unit are separated from each other and when the second cover is closed, the pressing roller and the heating roller of the fusing unit become in contact with each other.

19. An image forming apparatus comprising:

a main body;

a scanning unit disposed above the main body to be opened and closed by a predetermined angle;

a paper discharging cover that is disposed on a top end of the main body and below the scanning unit to open and close an opening formed on the top end of the main body and on which printing media that printing is complete are stacked;

a fusing unit that is disposed behind the paper discharging cover inside the main body and includes a pressing roller and a heating roller;

a first cover that is disposed above the fusing unit, and guides a printing medium passed through between the pressing roller and the heating roller to the paper discharging cover; and a second cover that is located in the main body above the first cover and covers the first cover;

wherein the second cover can be open independently of the scanning unit and the second cover can be opened simultaneously with the opening of the scanning unit;

wherein when the second cover is opened, the pressing roller and the heating roller of the fusing unit are separated from each other and when the second cover is closed, the pressing roller and the heating roller of the fusing unit become in contact with each other.

* * * * *